United States Patent [19]

Smolka

[11] 4,121,903

[45] Oct. 24, 1978

[54] METHOD OF MACHINE WASHING OF SOLID SOILED MATERIALS BY CONTACTING THE CIRCULATING WASH LIQUID WITH ALUMINOSILICATES

[75] Inventor: Heinz Smolka, Langenfeld, Germany

[73] Assignee: Henkel Kommanditgesellschaft auf Aktien, Dusseldorf-Holthausen, Germany

[21] Appl. No.: 847,791

[22] Filed: Nov. 2, 1977

[30] Foreign Application Priority Data

Nov. 2, 1976 [DE] Fed. Rep. of Germany ..... 2650278

[51] Int. Cl.[2] ..... B08B 3/00

[52] U.S. Cl. ..... 8/137; 68/13 A; 210/38 A; 252/179

[58] Field of Search ..... 8/137, 141; 252/179; 68/13 A; 210/24, 38 A

[56] References Cited

U.S. PATENT DOCUMENTS

| | | | |
|---|---|---|---|
| 3,023,132 | 2/1962 | Diamond et al. | 8/137 |
| 3,985,669 | 10/1976 | Krummel et al. | 252/179 |
| 4,040,972 | 8/1977 | Roebke et al. | 252/179 |
| 4,066,394 | 1/1978 | Leonard | 8/137 |
| 4,071,377 | 1/1978 | Schwugev et al. | 252/179 |
| 4,072,621 | 2/1978 | Rose | 252/179 |
| 4,072,622 | 2/1978 | Kuhling et al. | 252/179 |

*Primary Examiner*—William E. Schulz
*Attorney, Agent, or Firm*—Hammond & Littell

[57] ABSTRACT

An improvement in the machine washing of solid soiled materials comprising withdrawing and recycling the tap water in contact with said solid soiled materials through a silicate cation exchange compound having some combined water and a particle size of between 10 $\mu$ and 100 $\mu$ of the formula $$(M_{2/n}O)_x \cdot Me_2O_3 \cdot (SiO_2)_y$$

wherein M is a cation of valence $n$ exchangeable with calcium, Me is a member selected from aluminum and boron, $x$ is a number from 0.7 to 1.5 and $y$ is a number from 0.8 to 6, said agent having a calcium binding power of at least 50 mg of CaO per gram, said agent being maintained out of contact with said solid soiled materials, for such time until the water has a hardness of not more than 70 mg CaO/liter, then adding other soluble washing and cleaning compounds to said softened tap water and washing said solid materials while continuing the recycling of the wash solution through said silicate cation exchange compound.

12 Claims, 7 Drawing Figures

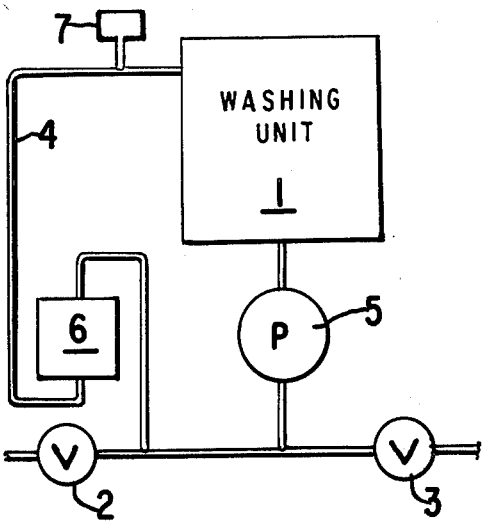
FIG. I
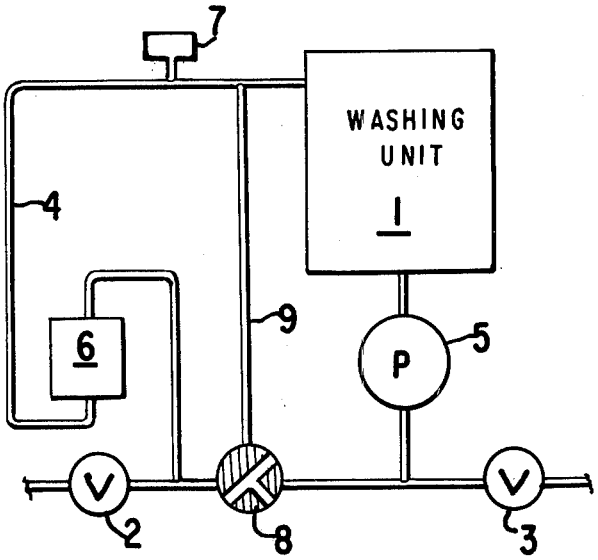
FIG. II
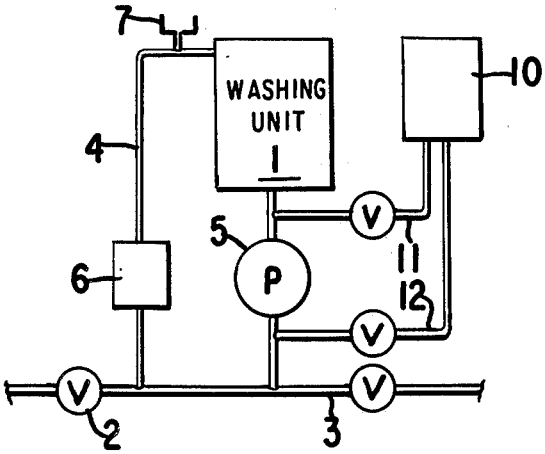
FIG. III
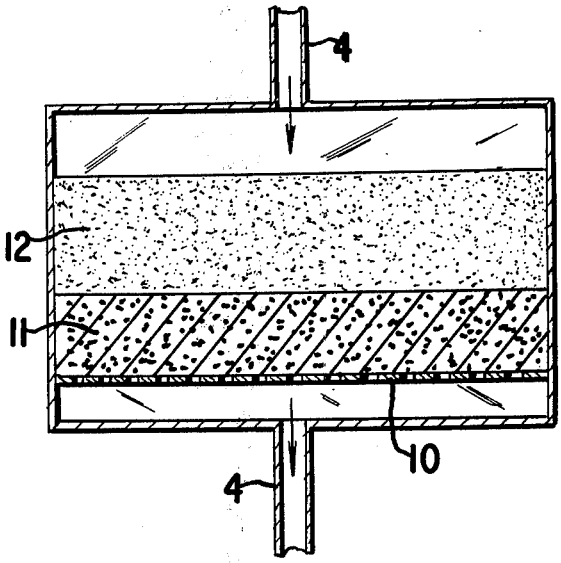
FIG. IV

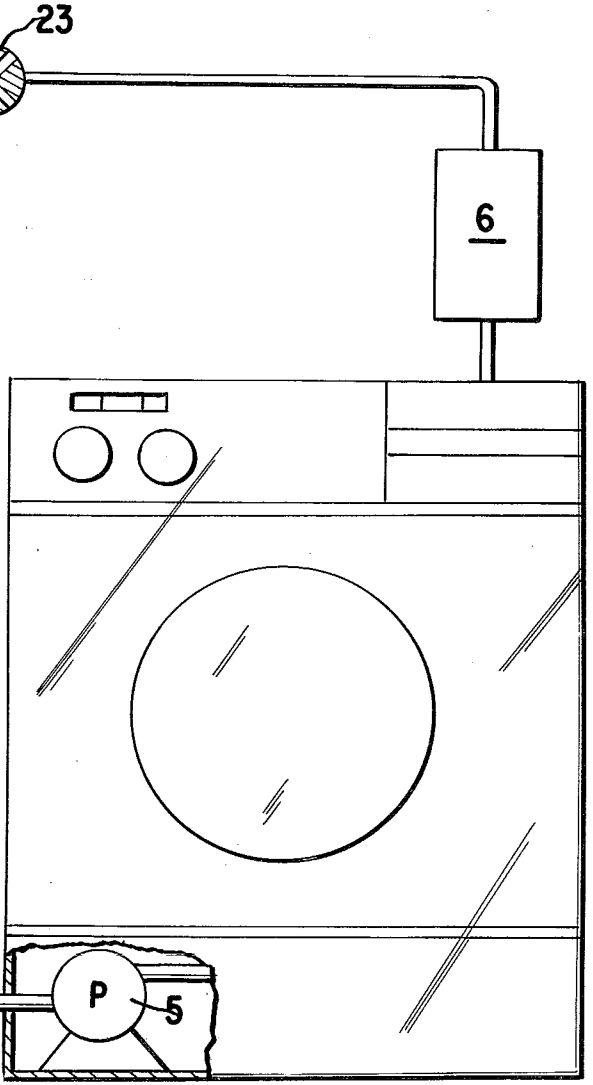
FIG. VI
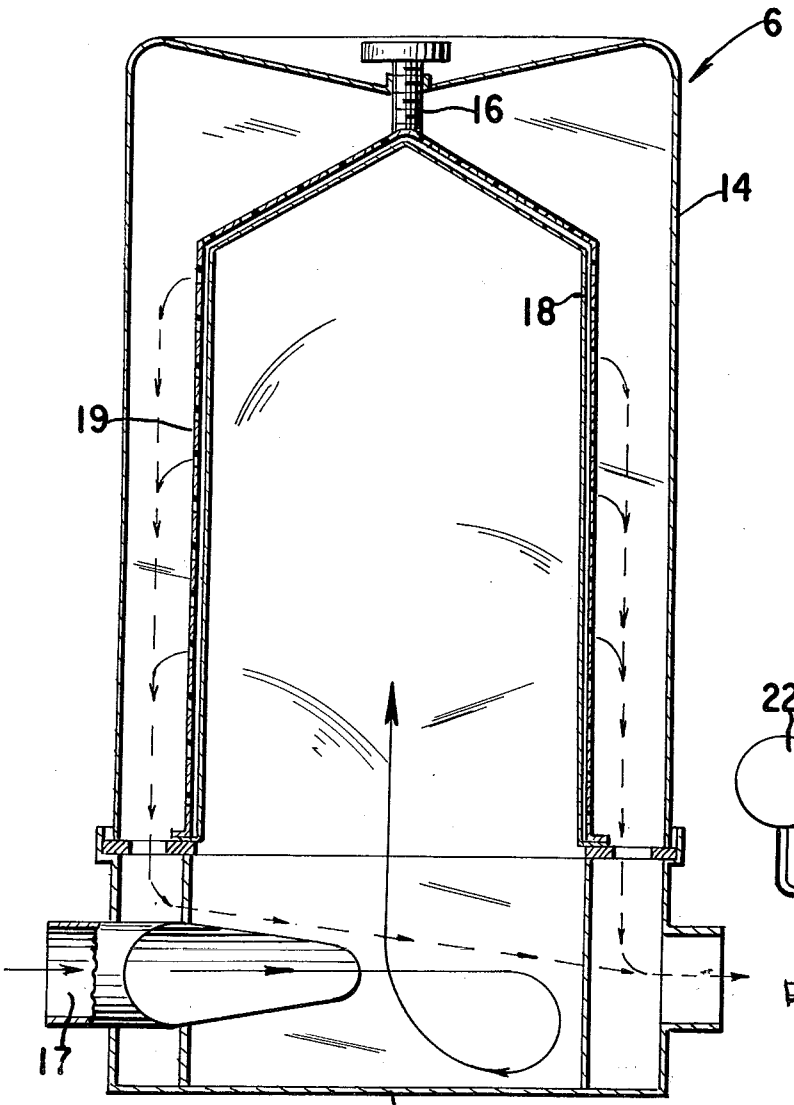
FIG. V

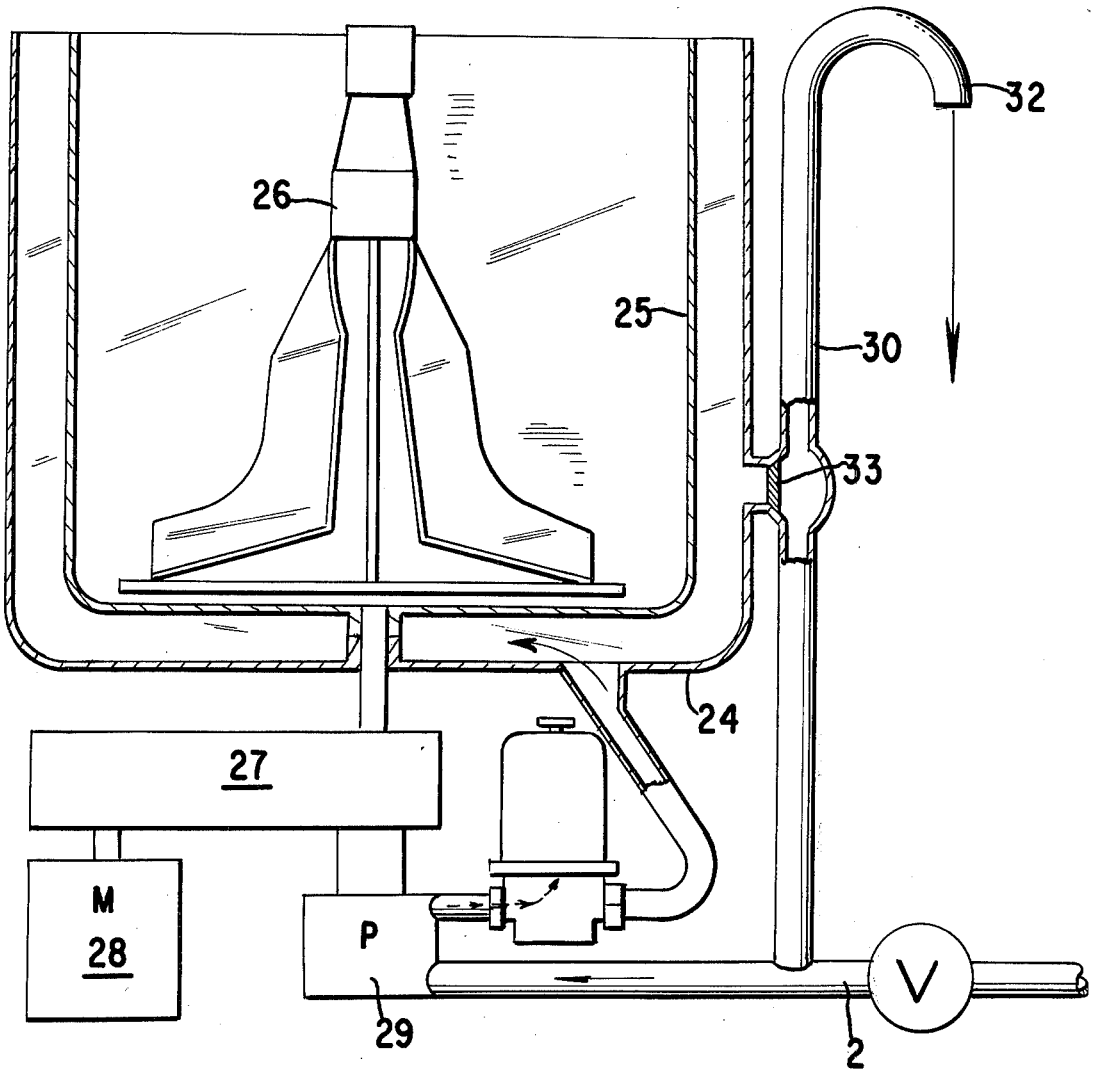
FIG. VII

METHOD OF MACHINE WASHING OF SOLID SOILED MATERIALS BY CONTACTING THE CIRCULATING WASH LIQUID WITH ALUMINOSILICATES

THE RELATED ART

Washing methods are known where the washing solution is circulated continuously during the washing process and conducted through one or more vessels in which the entrained dirt particles can settle from the wash water liquor before it is returned into the washing process. It has already been suggested to place screens or filters in the liquid circuit to retain coarse impurities or objects which could damage the mechanism. But since the bulk of the dirt is usually dissolved or dispersed in very finely divided form in the solution, the cleaning or regeneration of the solution is inadequate this way, and savings in certain washing and cleaning ingredients, for example, polymeric phosphates, cannot be achieved without a simultaneous decrease in the cleaning results.

In commercial laundries it is customary to prepare the washing solution with softened water, to which end the water to be used is first treated with an ion-exchange compound (e.g., a zeolite). But soft water has not sufficient washing power, even in the presence of surface-active substances to clean textiles and dishes in the absence of builders.

The problem is particularly serious when the articles to be washed carry soil which contains hardness formers, as pre-treatment of the wash water does not affect the hardness thereby introduced. This results in progressive incrustation of the material being washed.

Furthermore it has been suggested to effect the washing process in the presence of ion-exchangers based on organic polymers, which are added to the washing solution either in the form of a textile or as granular or powdered resins. But textile-type ion-exchangers have only a relatively low ion-exchange capacity, so that large amounts of the ion-exchange textile are required. Almost any amount of hardness is detrimental to washing solutions which contain an anionic detergent, and in most areas where hardness is a significant problem, it is necessary to decrease the hardness of the water by at least 50%. The space occupied by the ion-exchanger is at the expense of the material to be cleaned. Granular or powdered ion-exchange agents become caught in fabrics or garments being washed unless special precautions are taken, and the particles are difficult to recover when the washing operation is completed. If, as has likewise been suggested, the ion-exchange resin is enclosed in a guaze bag to prevent the agent from depositing on the textile fibers, the cleaning effect of the washihg solution is considerably decreased.

United States patent application Ser. No. 458,306, filed Apr. 5, 1974, now abandoned in favor of continuation application Ser. No. 800,308, filed May 25, 1977, discloses that the cleansing effected in the machine washing of laundry with detergent solutions is greatly improved when washing solutions have a uniformly distributed content of certain finely-divided ion-exchange aluminosilicates. It was found that these silicates have the capability of rapidly binding not only the calcium hardness ions which are normally present in the make-up water, but that they also have the capability of rapidly binding the hardness-imparting ions which become present in the water as the calcium-containing soil in the garments is solubilized.

It was believed, however, that to inactivate the calcium ions solubilized from the soil before these ions could react with and precipitate the anionic detergents usually present in the washing solution, the aluminosilicate must be present in direct or virtually direct contact with the fibers as the washing operation proceeded. It was seen that as a result, a considerable number of these particles became deposited within the textile fibers and in the pockets and seams of the garments, and this was a disadvantage of the process.

United States patent application Ser. No. 618,461, filed Oct. 1, 1975, discloses a method of machine washing and cleaning of solid materials with the use of low-phosphate or phosphate-free washing and cleaning solutions in the presence of water-insoluble cation exchangers which are able to bind the hardness formers of the water and of the impurities, characterized in that the cation exchanger has a calcium binding capacity of at least 50 mg CaO/gm and consists of a compound, containing combined water, of the formula $$(M_{2/n}O)_x \cdot Me_2O_3 \cdot (SiO_2)_y$$

where M is a cation, exchangeable with calcium, of the valence $n$; $x$ is a number from 0.7 to 1.5, Me is boron or aluminum; and $y$ is a number from 0.8 to 6; where the wash liquid is passed continuously or intermittently through an adsorption device which is adapted to separate the cation exchanger from the wash liquid.

According to this application, the washing and cleaning process can be performed, for example, by first adding the aluminosilicate simultaneously with a washing and cleaning agent, or respectively, in mixture therewith, to the cleaning liquid, and bringing this aluminosilicate containing wash solution in direct contact with the substrate. The aluminosilicate is collected in the adsorption device during the washing process, or at the latest before the start of rinsing. The invention claimed in this application is to collect the aluminosilicate in the adsorption device, already before the addition of the material to be washed or cleaned, thereby excluding direct contact of the material to be cleaned with the insoluble ion-exchanger. In this procedure there occurs a certain presoftening of the wash liquid containing the cleaning agent, before it comes in contact with the material to be cleaned.

Tests indicate that by this process, aluminosilicates of the larger particle sizes can be employed while obtaining excellent wash results, which results are as good as the results obtained by the use of smaller particle sized aluminosilicates in direct contact with the materials being washed.

OBJECTS OF THE INVENTION

An object of the present invention is the development of a process for washing solid soiled materials employing larger particle sized aluminosilicates wherein an enhanced washing effect is had.

Another object of the present invention is the development of a method for machine washing and cleaning of solid materials utilizing washing and cleaning solutions in the presence of water-insoluble cation exchange agents which are capable of binding the hardness components of the water and the soil, comprising withdrawing and recycling the tap water having a hardness of more than 80 mg CaO/liter in contact with said solid soiled materials through a silicate cation exchange compound having some combined water and a particle size of between 10μ and 100μ of the formula $$(M_{2/n}O)_x \cdot Me_2O_3 \cdot (SiO_2)_y$$

wherein M is a cation of valence $n$ exchangeable with calcium, Me is a member selected from aluminum and boron, $x$ is a number from 0.7 to 1.5 and $y$ is a number from 0.8 to 6, said agent having a calcium binding power of at least 50 mg of CaO per gram, said silicate cation exchange compound being maintained out of contact with said solid soiled materials in a separate area from the washing area, for such time until the water has a hardness of not more than 70 mg CaO/liter, then adding other soluble washing and cleaning compounds to said softened tap water and washing said solid materials while continuing the recycling of the wash solution through said silicate cation exchange compound, wherein the total amount of washing solution is continuously or intermittently cyclically circulated from the washing area through the separate area with the cation exchange compound and then back to the washing area at least five times during the cleaning process, and where the amount of the cation exchange compound is 0.2 gm to 10 gm per liter of washing solution, and said washing solution contains from 0.2 to 10 gm per liter of other soluble washing and cleaning compounds.

These and other objects of the present invention will become more apparent as the description thereof proceeds.

THE DRAWINGS

FIGS. 1, II and III are flow diagrams of the processes according to the invention.

FIGS. IV and V show schematically in section a fixed bed and a fluid bed filter suitable for use in the process of the invention.

FIG. VI shows schematically an elevation of a machine washer useful for the process according to the present invention, and FIG. VII shows a vertical section of another machine washer useful for the process according to the present invention.

DESCRIPTION OF THE INVENTION

I have now found that the cleaning results as described in Ser. No. 618,461 can be further enhanced by proceeding in the manner described below. The subject of the invention is a method according to Ser. No. 616,461, characterized in that, before adding the other washing and cleaning compounds, the cleaning liquid is softened by means of the admitted aluminosilicate to a hardness of not more than 7° dH (70 mg CaO/liter), preferably less than 5° dH (50 mg CaO/liter).

By the "other washing and cleaning compounds" must be understood the various compounds mentioned in Ser. No. 616,461, and Ser. No. 458,306 and its continuation Ser. No. 800,308, such as calcium complexing and precipitation agents, surfactants, builders, bleaches as well as activators or stabilizers for such bleaches, soil suspension agents, enzymes as well as other additives normally contained in washing and cleaning agents.

More particularly, the present invention relates to a method for machine washing and cleaning of solid materials utilizing washing and cleaning solutions in the presence of water-insoluble cation exchange agents which are capable of binding the hardness components of the water and the soil, comprising withdrawing and recycling the tap water having a hardness of more than 80 mg CaO/liter in contact with said solid soiled materials through a silicate cation exchange compound having some combined water and a particle size of between 10μ and 100μ of the formula $$(M_{2/n}O)_x \cdot Me_2O_3 \cdot (SiO_2)_y$$

wherein M is a cation of valence $n$ exchangeable with calcium, Me is a member selected from aluminum and boron, $x$ is a number from 0.7 to 1.5 and $y$ is a number from 0.8 to 6, said agent having a calcium binding power of at least 50 mg of CaO/gm, said silicate cation exchange compound being maintained out of contact with said solid soiled materials in a separate area from the washing area, for such time until the water has a hardness of not more than 70 mg CaO/liter, then adding other soluble washing and cleaning compounds to said softened tap water and washing said solid materials while continuing the recycling of the wash solution through said silicate cation exchange compound, wherein the total amount of washing solution is continuously or intermittently cyclically circulated from the washing area through the separate area with the cation exchange compound and then back to the washing area at least five times during the cleaning process, and where the amount of the cation exchange compound is 0.2 gm to 10 gm per liter of washing solution, and said washing solution contains from 0.2 to 10 gm per liter of other soluble washing and cleaning compounds.

The softening of the tap water wash liquid, which precedes the addition of washing and cleaning agent, can be done by contacting the fresh water flowing into the washer with the aluminosilicate, for example, by putting the aluminosilicate into the detergent charging device of a washing or dishwashing machine and collecting it in the adsorption device or on the filter by repeated recycling of the liquid prior to the addition of the soiled material. Alternatively, the liquid in contact with the soiled materials may be cycled through an aluminosilicate exchanger already disposed in the adsorption device, this exchanger being present as powder, granulated material or also in the form of a filter plate or filter cartridge. Depending on the quantity and nature of the aluminosilicate exchanger or, respectively, the hardness of the fresh water, generally one to five pumping cycles are required to obtain the desired initial hardness of the wash liquid. Alternatively, the fresh water may be passed directly from the tap through the aluminosilicate exchanger, thereby partially softening it already during the filling and thereafter recycled to obtain the desired initial hardness of the wash liquid.

During the preliminary softening, the substrate or soiled material, such as the textile material or the dishes to be cleaned, is already in the washing and cleaning apparatus which is agitated or sprayed, respectively, to contact the soiled material with the circulating softening water. The advantage of this is that superficially adhering, easily removable hardness formers are removed at the same time and fixed by the ion-exchanger. The tap water employed in the process should have a specific hardness which should be over 80 mg CaO/liter (8° dH) for the process of the invention to be of advantage. City water supplies with a hardness in excess of 150 mg CaO/liter are common. The "fresh water" may be part of the rinse water from the preceding washing operation, whereby an additional saving of water is achieved, particularly if the tap water is high in hardness.

After completed softening of the water to a hardness of not more than 7° dH, preferably less 5° dH, and in particular less than 3° dH, the other washing and cleaning agent components or their mixtures are added and the process is carried out by circulating the wash liquor continuously or intermittently through the aluminosilicate collected in the adsorption device, which does not come into direct contact with the material to be cleaned.

An aluminosilicate having a mean particle size of more than 10μ is employed in the form of a bed. The water to be softened, then the washing solution is pumped through the bed continuously or intermittently as the washing proceeds where the aluminosilicate is in a separate vessel restrained by a filter means. By this means the calcium hardness of the tap water can be decreased by more than 50% and the washing solution can be maintained at a negligibly low level of hardness. The bed may be a static bed composed of particles or agglomerated particles of the aluminosilicate in a range of from 10μ to 100μ or the aluminosilicate may be in the form of a solid, porous block, in which event, the block acts as a filter. The bed may be a fluidized bed, in which event the cation exchange agent is present in divided form in aqueous suspension in a vessel apart from the objects being washed. The particles may be surrounded by a porous envelope or sleeve, which acts as a filter.

Of particular advantage, is the use of a detergent composition which contains an anionic surface-active compound and a substoichiometric amount of a water-soluble sequestering agent. The aqueous wash solution should contain from 0.1 to 1 gm/liter of an anionic surface-active compound and 0.5 gm/liter to 2 gm/liter of a water-soluble sequestering agent for calcium as an assistant or adjuvant for the ion-exchange agent.

It is usually necessary that the amount of cationic exchange aluminosilicate used be sufficient to bind substantially all of the hardness present.

The process of the invention can be performed in a conventional machine washer which comprises in combination a tub adapted to contain the objects to be washed, a conduit having a pump therein adapted to circulate washing solution from one portion of said tub to another portion of said tub, and a vessel in said conduit adapted to contain said ion-exchange agent having a particle size in excess of 10μ. The vessel may be a static bed filter or a filter of the fluid bed type, containing the aluminosilicate in one of the forms described above. The vessel is hereinafter sometimes for convenience termed a "filter", but it will be understood that in each instance it also performs the function of binding the ions which cause hardness in water.

In practicing the method of the invention, a silicate cation exchanger compound is employed having a particle size of between 10μ and 100μ, a calcium binding capacity of at least 50 mg CaO/gm on an anhydrous basis and the formula $$(M_{2/n}O)_x \cdot Me_2O_3 \cdot (SiO_2)_y$$

wherein M denotes a water-soluble cation of valence $n$ exchangeable with calcium, $x$ denotes a number from 0.7 to 1.5, Me denotes boron or aluminum, and $y$ denotes a number from 0.8 to 6, said silicate cation exchanger compound containing some combined water.

Compounds in which Me = Al and $y$ = 1.3 to 3.3 are preferred. Their calcium binding capacity is preferably 100 to 200 mg CaO/gm on the anhydrous basis. They are hereafter called "aluminosilicates" for brevity.

Sodium is preferred as the cation, followed by lithium, potassium, ammonium or magnesium, as well as the cation of water-soluble organic bases, e.g., those of primary, secondary or tertiary alkylamines or alkylolamines with not more than two carbon atoms per alkyl radical, or not more than three carbon atoms per alkylol radical. Preferably M is an alkali metal, especially sodium.

Aluminosilicates of the type described above are commercially available and are produced synthetically in a simple manner, for example, by reacting water-soluble silicates with water-soluble aluminates in the presence of water. Thus, aqueous solutions of the starting materials can be mixed with each other, or one component which is present in solid form can be reacted with the other component which is present as in dissolved state. By mixing both components in solid form in the presence of water, the desired aluminosilicates are also obtained. Aluminosilicates can also be obtained from $Al(OH)_3$, $Al_2O_3$ or $SiO_2$ by reacting them with alkali metal silicate or alkali metal aluminate solutions, respectively. Particularly effective aluminosilicates are formed if the special precipitation conditions are observed which are described in detail in said copending application Ser. No. 458,306. In similar manner the boron analogues can be formed.

The aluminosilicates produced by precipitation or transformed in finely divided form into aqueous suspension by other methods are transformed by heating to temperatures of 50° C. to 200° C. from the amorphous into the aged or crystalline state. Crystalline aluminum silicates are preferred for the purposes of the invention. Particularly suitable are aluminosilicates of the composition:

0.7 to 1.1 $Na_2O \cdot Al_2O_3$ 1.3 to 3.3 $SiO_2$.

The crystalline aluminosilicate which is present in aqueous suspension can be separated by filtration from the remaining aqueous solution and dried at temperatures of 50° C. to 400° C. (preferably 80° to 200° C.). The product after drying contains more or less bound water.

The water-containing aluminosilicates thus produced after the disintegration of the dried filter cake are obtained as a fine powder whose primary particle size does not exceed 0.1 mm, but which is mostly less, down to 10μ. It must be kept in mind that the primary particles can be agglomerated to larger structures. More finely divided aluminosilicates may be utilized down to a dust fineness of 0.01μ. However, such finely-divided aluminosilicates are more difficult to filter effectively.

A method of improving the filtering capacity of the aluminosilicates, if desired, consists in using filter aids, like kieselguhr (silica), diatomaceous earth, pumice powder, cellulose, or finely ground plastic foam. The aluminosilicate can also be deposited or adsorbed on these porous materials, improving the filtering capacity during the production or after in order to increase this way the particle size.

Clogging of the filter when using aluminosilicates can also be prevented and at the same time the washing process can be accelerated and the cleaning result improved and the exchanger capacity better utilized by keeping the aluminosilicate constantly in motion inside the filter, for example, by recycling the cleaning solution intermittently or repeatedly, and by reversing its direction of flow during the washing process. Preferably a so-called "whirlpool bed filter" is used for the purpose where the turbulence of the filter contents (the ion-exchange zeolite in particulate form) is increased by suitable design of the filter, the filter vessel, or of the feed lines.

The process of the present invention is ordinarily used with waters which have a normal hardness in excess of about 80 mg of CaO equivalent per liter, i.e., with waters which have an initial hardness of the amount or which develop this hardness as the washing proceeds.

The amount of aluminosilicate required to obtain a good washing or cleaning effect depends, on the one hand, on its calcium binding power, and on the other hand, on the amount of dirt in the materials to be washed and on the hardness and the amount of water used. The amount of aluminosilicate should be so determined that the residual hardness of the water, before addition of the detergents, does not exceed 7° dH (German hardness; corresponding to 70 mg CaO/liter), preferably 5° to 3° dH (50 to 30 mg CaO/liter). In order to obtain an optimum washing or cleaning effect, it is advisable to use a certain excess of aluminosilicate, particularly in the case of greatly soiled substrates, in order to completely or partly bind the hardness formers contained in the released dirt. In most instances, accordingly, the amount used per cleaning cycle ranges between 0.2 to 10 gm of aluminosilicate, particularly 1 to 6 gm of aluminosilicate per liter of wash water, so as to maintain the hardness of the wash solution as close to zero as is practicable.

It was also found that the dirt can be removed much faster and/or more completely if a water-soluble substance is added to the aqueous solution of detergent which exerts a sequestering (i.e., a complex-forming) and/or precipitating effect on the calcium obtained in the soil. Suitable as sequestering agents for calcium for the purposes of the invention are also substances with such a low sequestering power that they were not considered heretofore as typical sequestering agents for calcium, but these compounds are frequently capable of delaying the precipitation of calcium carbonate from aqueous solutions. The sequestrants or precipitants binding calcium ions can be present in substoichiometric amounts, related to the hardness formers present. They act as "carriers," that is, their calcium salts are transformed into soluble salts by contact with the ion-exchanger and they are thus again available as sequestrants.

Preferably small amounts of sequestrants or precipitants for calcium are used, e.g., 0.05 to 2 gm/liter in order to speed up or improve the removal of impurities. Particularly, amounts of 0.1 to 1 gm/liter are used. Substantially larger amounts can also be used, but in the case of phosphorus-containing sequestrants or precipitants the amounts should be so selected that the phosphorus load of the waste water is less than with the use of the customary detergents based on triphosphate.

The sequestrants or precipitants comprise those of an inorganic nature such as the water-soluble alkali metal (particularly the sodium) and ammonium pyrophosphates, triphosphates, higher polyphosphates, and metaphosphates.

Organic compounds which act as sequestrants or precipitants for calcium include the water-soluble polycarboxylic acids, hydroxycarboxylic acids, aminocarboxylic acids, carboxyalkyl ethers, polyanionic polymers and water-soluble salts thereof, particularly the polymeric carboxylic acids and the phosphonic acids, which are used as acids, alkali metal or aluminum salts and preferably as sodium salts.

Examples of polycarboxylic acids are dicarboxylic acids of the general formula $$HOOC-(CH_2)_n-COOH$$

wherein $n = 0$ to 8, in addition, maleic acid, methylenemalonic acid, citraconic acid, mesaconic acid, itaconic acid, acyclic polycarboxylic acids with at least three carboxyl groups in the molecule, such as, for example, tricarballylic acid, aconitic acid, ethylene tetracarboxylic acid, 1,1,3,3-propanetetracarboxylic acid, 1,1,3,3,5,5-pentanehexacarboxylic acid, hexanehexacarboxylic acid, cyclic di- or polycarboxylic acids, such as, for example, cyclopentanetetracarboxylic acid, cyclohexanehexacarboxylic acid, tetrahydrofurantetracarboxylic acid, phthalic acid, terephthalic acid, benzene-tri-, tetra- or pentacarboxylic acid, as well as mellitic acid.

Examples of hydroxymono- or polycarboxylic acids are glycolic acid, lactic acid, malic acid, tartronic acid, methyl tartronic acid, gluconic acid, glyceric acid, citric acid, tartaric acid, and salicylic acid.

Examples of aminocarboxylic acids are glycine, glycolglycine, alanine, asparagine, glutamic acid, aminobenzoic acid, iminodi- or triacetic acid, (hydroxyethyl)-iminodiacetic acid, ethylenediaminetetraacetic acid, (hydroxyethyl)-ethylenediaminetriacetic acid, diethylenetriaminepentaacetic acid, as well as higher homologues, which can be obtained by polymerization of an N-aziridylcarboxylic acid derivative, e.g., acetic acid, succinic acid, tricarballylic acid and subsequent saponification or by condensation of polyimines with a molecular weight of 500 to 10,000 with salts of chloroacetic or bromoacetic acid.

Examples of carboxyalkyl ethers are 2,2-oxydisuccinic acid and other ether polycarboxylic acids, particularly polycarboxylic acids containing carboxymethyl ether groups which comprise corresonding derivatives of the following polyvalent alcohols or hydroxycarboxylic acids, which can be completely or partly etherified with the glycolic acid:

glycol
di- or triglycols
glycerin
di- or triglycerin
glycerin monomethyl ether
2,2-dihydroxymethyl-propanol
(1,1,1-trihydroxymethyl)-ethane
(1,1,1-trihydroxymethyl)-propane
erythrite
pentaerythrite
glycolic acid
lactic acid
tartronic acid
methyltartronic acid
tartaric acid
trihydroxy glutaric acid
saccharic acid
mucic acid.

As transition types to the polymeric carboxylic acids are the carboxymethyl ethers of sugar, starch and cellulose.

Among the polymeric carboxylic acids, the polymers of acrylic acid, hydroxyacrylic acid, maleic acid, itaconic acid, mesaconic acid, aconitic acid, methylene malonic acid, citraconic acid, etc., the copolymers of the above-mentioned carboxylic acids with each other or with ethylenically unsaturated compounds, such as ethylene, propylene, isobutylene, vinyl alcohol, vinyl methyl ether, furan, acrolein, vinyl acetate, acrylamide, acrylonitrile, methacrylic acid, crotonic acid, etc., such as the 1:1 copolymers of maleic acid anhydride and ethylene or propylene or furan, play a special role.

Other polymeric carboxylic acids of the type of the polyhydroxypolycarboxylic acids or polyaldehydopolycarboxylic acids are substantially substances composed of acrylic acid and acrolein units or acrylic acid and vinyl alcohol units which can be obtained by copolymerization of acrylic acid and acrolein or by polymerization of acrolein and subsequent Cannizzaro reaction, if necessary, in the presence of formaldehyde.

Examples of phosphorus-containing organic sequestrants are alkane-polyphosphonic acid, amine- and hydroxyalkane polyphosphonic acids and phosphono-carboxylic acids, such as:

methane diphosphonic acid
propane-1,2,3-triphosphonic acid
butane-1,2,3,4-tetraphosphonic acid,
polyvinyl phosphonic acid
1-amino-ethane-1,1-diphosphonic acid
1-amino-1-phenyl-1,1-diphosphonic acid
aminotrimethylene phosphonic acid
methylamine- or ethylamine-dimethylene phosphonic acid
ethylene-diaminetetramethylene phosphonic acid
1-hydroxyethane-1,1-diphosphonic acid
phosphonoacetic acid
phosphonopropionic acid
1-phosphonoethane-1,2-dicarboxylic acid
2-phosphonopropane-2,3-dicarboxylic acid
2-phosphonobutane-1,2,4-tricarboxylic acid
2-phosphonobutane-2,3,4-tricarboxylic acid, as well as copolymers of vinyl phosphonic acid and acrylic acid.

The process of the present invention permits a reduction in the use of phosphorus containing inorganic or organic sequestrants or precipitants to a content of inorganically or organically combined phosphorus in the treatment liquors to less than 0.6 gm/liter, and preferably to less than 0.3 gm/liter, or the working of the process completely without phosphorus-containing compounds.

The process of the present invention is usefully applied to waters of any given objectionable level of hardness.

Apart from washing textiles, which is the preferred field of application, the method and the device according to the invention are also suitable for any other cleaning operations where it is possible or of advantage to return or regenerate the tap water or the cleaning solution. These applications comprise the cleaning of instruments, apparatus, pipe lines, boilers and vessels of any material, such as glass, ceramic material, enamel, metal or plastic. An example is the industrial cleaning of bottles, drums and tank cars. The method is also particularly suitable for use in commercial or household dishwashing machines.

Depending on the use, customary surfactants, builder substances which increase the cleaning power, bleaching agents, as well as compounds which stabilize or activate such bleaching agents, soil-suspension agents or greying inhibitors, optical brighteners, biocides or bacteriostatic substances, enzymes, foam inhibitors, corrosion inhibitors and substances regulating the pH value of the solution can be present in the washing and cleaning process. Such substances, which are normally present in varying amounts in the washing, rinsing and cleaning agents, are listed specifically in Ser. No. 458,306.

When using one or more of the above-mentioned substances which are generally present in cleaning liquors, the following concentrations are preferably maintained:

Grams per liter 0 to 2.5 surfactants
0.01 to 3 sequestrants
0 to 3 other builder substances
0 to 0.4 active oxygen or equivalent amounts of active chlorine.

The pH of the treatment liquors can range from 6 to 13, depending on the substrate to be washed or cleaned; preferably it is between 8.5 and 12.

The treatment temperature can vary within wide limits and is between 20° C. and 100° C. Since the washing and cleaning effect is already very high at low temperatures, that is, between 30° C. and 40° C., exceeds that of conventional detergents and methods, it is possible to wash very delicate fabrics in this range, e.g., those of wool or silk or very fine porcelain dishes with a very delicate overglaze or gold trim without damaging them.

The washing or cleaning time at the anticipated treatment temperature depends on the degree of soiling, the exchange rate, and the output of the pump. It can, therefore, vary within wide limits, for example, from five minutes or two hours. Preferably, it is between 10 and 60 minutes as this is usually sufficient to effect substantially complete removal of soil. The output of the pump and of the filter are preferably so selected that the cleaning solution is circulated at least twice during the washing period. The washing solution should pass at least five times and preferably ten to about fifty times through the filter charged with the aluminosilicate. This output should also be achieved if the filter becomes partially clogged by the deposited material and has become difficult to penetrate.

It is, therefore, advisable to use pumps which still assure a sufficient output at a certain back-pressure, e.g., of 1 to 2 atmospheres above normal. Of advantage are filter arrangements where the trapped solids (including the aluminosilicates) are intensively whirled up so that there are no major deposits on the filters during the washing process. Such an arrangement ("whirlpool bed") unlike a fixed bed arrangement of the exchanger, permits shorter washing times and thus the use of smaller and constructionally less elaborate pumps. This effect can be further increased by intermittent operation or reversal of the direction of flow.

The pore size of the filter depends on the particle size of the aluminosilicate. Since the deposited material or the additionally used filter aid have also a filter effect, the pore size can be greater than corresponds to the particle size of the fine portions in the interest of a lower flow resistance. With a mean particle size of the aluminosilicate of 10 to 50$\mu$, the pore size of the filter can, therefore, be 50 to 150$\mu$, for example, preferably 80 to 120$\mu$, which also applies to the case where the particle size is relatively wide.

The filter element in the device containing the ion-exchange material can consist of any material, for example, paper, textile fabric, ceramic material, or ion-exchange material itself. To advantage are used paper filters which are discarded together with the deposited ion-exchange material as well as mechanical impurities and lint, or in dishwashing machines food remnants removed from the substrate or retained by the filter. The advantage is that new ion-exchange material with a reproducible activity is used for each cleaning process. Neither the aluminosilicate nor the filter material as "pollution-free" garbage represents a burden for the garbage dumps and incinerators.

On the other hand, the ion-exchange material can be regenerated, which may be suitable for lumpy or shaped exchangers. Regeneration, when employed, is preferably effected with highly concentrated common salt solutions. Regeneration can also be effected with solutions of the above-mentioned sequestrants, but this is less advisable because of cost and because of the possible pollution of sewage by the spent solution.

In certain instances it is advantageous to retain even fine portions below $1\mu$, for example, down to $0.1\mu$, by correspondingly varying the dimensions of the adsorption means. In this case, not only the aluminosilicates, but the suspended dirt particles are also practically completely separated. By this means the cleaning solution can be clarified to such an extent that it can be used again after recovery for a later washing or cleaning process without losing its cleaning power. The necessary replacement of fresh water can be confined to the amount of water retained by the textile or other materials to be cleaned and by the adsorption device. The amount of water required for rinsing can also be considerably reduced, since washing out of the suspended dirt particles is eliminated and only the adsorbed or dissolved components of the washing and cleaning agent have to be removed. In this way, up to 80% water can be saved, compared to a conventional washing process. In a special embodiment, the removed and clarified cleaning solution can be conducted additionally over a carbon filter, which also completely or partly retains the dissolved surfactants. Without prior removal of the suspended dirt particles, as it is accomplished by the method according to the invention, such a filter is soon exhausted and is uneconomical for use.

The device (i.e., the apparatus) according to the invention consists at least of the following components:

(a) A washing or cleaning unit or dishwashing unit which may be of a conventional or modified construction.

(b) A cycle system equipped with a circulating pump, (c) At least one adsorption device, such as a filter unit in the cycle system for containing the calcium binding agent.

Moreover, the following arrangements have proved successful for the practice of the process of the invention:

(d) A fresh water inlet, connected with the adsorption device, and (e) A feeding or proportioning device for the washing and cleaning agent, disposed in the cycle system.

The invention is further illustrated by the drawings wherein:

FIGS. I, II and III are flow diagrams of processes according to the present invention;

FIGS. IV and V show schematically in section a fixed bed and a fluid bed filter suitable for use in the process of the invention;

FIG. VI shows schematically an elevation of a machine clothes washer according to the present invention, and FIG. VII shows a vertical section of another machine clothes washer according to the present invention.

In the Figures, the same numbers designate similar or equivalent components.

In FIG. I the apparatus consists of washing or cleaning unit 1 equipped with valved make-up water inlet 2, valved outlet 3, for discharge of the washing solution, and cycle conduit 4, circulating pump 5, and vessel 6 for containing the calcium binding agent, as well as a washing and cleaning agent feed means 7 connected to the cycle conduit 4.

FIG. II illustrates a modification of the apparatus of FIG. 1 where the bulk of the circulated cleaning liquid is by-passed around the calcium binding agent vessel 6 and is thus returned directly into the cleaning unit. For this purpose cycle conduit 4 is provided with three-way valve 8 and by-pass conduit 9 which thus permits part or virtually all of the wash water to be circulated through or around the vessel containing the calcium binder. This arrangement is provided for those cleaning units where the mechanical treatment of the material to be cleaned is effected by the circulating cleaning liquor by means of stationary or movable spray nozzles, as is customary, for example, in dishwashing machines or in washing apparatus with suspended textiles. A filter arranged in the main cycling current would offer in these cases a too high resistance to the flow of the cleaning liquor. Valve 8 can be operated intermittently if desired. In continuous washing or spraying plants, it is also possible to arrange two or more ion exchangers, which are equipped with shut-off and draining devices. The filter with exhausted exchangers can then be replaced without having to interrupt the cleaning process.

FIG. III shows a modification of the apparatus of FIG. I to permit the cleaning solution in whole or in part to be stored for further use in the process. For this purpose a storage tank 10 is provided which is connected to cycle conduit 4 by a valved feed line 11 and a return valved line 12. A portion of the rinse water, for example, from the last rinse cycle, can be pumped via line 11 into the tank 10 and be tapped therefrom as needed and fed via the return line 12 into the cycle conduit 4 and the adsorption device or vessel 6 into the washing unit 1.

FIG. IV shows a vessel 6 containing the calcium ion binder in the form of a fixed bed suitable for use as calcium ion binder vessel 6 in FIGS. I, II and III. In FIG. IV, the vessel comprises porous retaining plate 10, filter aid 11 and deposited aluminosilicate 12.

FIG. V shows a vessel 6 for retaining the calcium binder in fluid bed form, which usually provides better results. In FIG. V, the vessel 6 comprises two-part housing having bottom 13, cover 14, sealing ring 15 and pressure screw 16. In operation, the wash liquor, the path of which is marked by arrows (unfiltered solid, filtered dashed lines), enters the vessel through inlet 17, vigorous turbulence being ensured by a suitable (for example, tangential) arrangement of the inlet. After passing through container bag 18, which can consist of paper or textile material, and perforated container 19, the liquor arrives in the outer jacket of the housing and flows from there into outlet connection 20. The vessel can be emptied and cleaned in a simple manner after bag 18 has been removed.

FIG. VI illustrates one form of apparatus suitable for performing the examples. The apparatus is a modified home laundry washing machine. In the machine, fresh water from inlet 2 flows through the conduit 4, and circulating pump 5 discharges through conduit 4 to flowmeter 21, three-way sampling valve 23 and calcium binder vessel 6. Conduit 4 is provided with manometer 22 which permits the back-pressure in the system to be determined. Sampling valve 23 permits the condition of the wash water to be observed during the washing process. For example, the degree of clouding or contamination of the treated washing solution can be determined.

FIG. VII illustrates another form of laundry machine washer, suitable for performing the examples. The apparatus here comprises a tub washing machine comprising tank 24, laundry basket 25, and beater cross 26 for mechanically agitating the wash. Basket 25 and cross 26 are driven through reversing gear 27 by motor 28. The same gear also drives circulatory pump 29. The fresh water from fresh water inlet 2 and the circulated washing solution flows from the tank into ring conduit 30 to pump 29 and from there into vessel 31 for containing the calcium ion binder back into the tank. After the completion of the washing process, the washing solution is discharged through outlet 32 after reversing the pump, the non-return valve 33 being closed to prevent the washing solution from flowing back into the tank.

The invention is not limited to the arrangement represented here. Rather these can be supplemented and modified in many ways. The aluminosilicates used in the process of the present invention can be prepared in simple manner, for example, by reacting a water-soluble silicate with a water-soluble aluminate in appropriate proportions in the presence of water. Thus sodium aluminate solution diluted with deionized water is added to sodium silicate solution. The desired product precipitates. The product when dried at first is amorphous, but turns into a crystalline material after prolonged standing. The formation of large crystal aggregates is enhanced by standing. Vigorous stirring during the precipitation and recrystallization period leads to a finely divided product. After the liquor from the crystal sludge has been drained off and the sludge has been washed with deionized water until the outflowing wash water has a pH of about 10, the filter residue is dried. If necessary, the residue can be ground in a ball mill and separated in a centrifugal sifter into fractions of various particle size. The particle size distribution can be determined by means of a sedimentation balance.

The calcium binding power of the aluminosilicates is determined as follows:

One gram of aluminosilicate was added to one liter of an aqueous solution containing 0.594 gm of $CaCl_2$ (= 300 mg CaO/liter = 30° dH) standardized with diluted NaOH to 10. Then the suspension was stirred vigorously for 15 minutes at a temperature of 22° C. (± 2° C.). After filtering off the aluminosilicate, the residual hardness ("$x$") of the filtrate is determined. From this value the calcium binding capacity in mg CaO/gm of active substances (= AS) is calculated according to the following formula:

$(30-x)\cdot 10$, where an anhydrous product which had been heated for one hour at 800° C. is used as active substance.

The percentages indicated below are percent by weight.

| Production Conditions for Aluminosilicate Al: | |
|---|---|
| Precipitation: | 2.985 kg aluminate solution of the composition: 17.7% $Na_2O$, 15.8% $Al_2O_3$, 66.6% $H_2O$<br>0.15 kg caustic soda<br>9.420 kg water<br>2.445 kg of a 25.8% sodium silicate solution freshly prepared from commercial waterglass and easily alkali-soluble silica of the composition: 1 $Na_2O$ . 6.0 SiO2 |
| Crystallization: | 24 hours at 80° C |
| Drying: | 24 hours at 100° C |
| Composition: | 0.9 $Na_2$. O 1 $Al_2O_3$ . 2.05 $SiO_2$ . 4.3 $H_2O$ (= 21.6% $H_2O$) |
| Degree of Crystallization: | Fully crystalline |
| Calcium binding capacity: | 150 mg CaO/gm of active substance. |

The primary particle sizes of the aluminosilicate range from 10 to 45μ with a maximum at 20 to 30μ.

The invention is further illustrated by the examples which follow. These examples are illustrative of the process of the invention. However, they are not to be construed as limitations thereof.

EXAMPLES 1 TO 3

The following illustrates the washing of a variety of fabrics carrying a standard soil (including iron soil) in water having a high concentration of calcium hardness components and containing anionic detergents. The washing was performed in a commercial drum washing machine (of the Lavamat SL type) with a horizontally mounted drum modified as shown in FIG. VI, where the ion-exchange vessel corresponds to that of FIG. IV.

The aluminosilicate employed was prepared similarly to the aluminosilicate Al described above and had a particle size in the range of 20 to 70μ with a maximum in the range of 30μ to 50μ. The aluminosilicate was placed in the filter together with 10% by weight of diatomaceous earth serving as filtering aid. Then the washing machine was charged with 3 kg of clean fill-up laundry as well as two textile samples each (20 × 20 cm) of cotton (C), finished cotton (F.C.) and a blend of 50% polyester and 50% finished cotton (P/C). The textile samples were artifically soiled with skin fat, kaolin, iron oxide black and carbon black; this simulates the soil of naturally soiled garments.

The admitted tap water (quantity 20 liters, hardness 16° dH, 160 mg CaO/liter) was passed through valved line 2 to and through the filter 6 charged with aluminosilicate immediately on being let in and then circulated for another ten minutes with agitation of the laundry. At this point, the hardness was less than 4° dH. Subsequently, the washing agent was added and the wash liquor was heated to 90° C. During the 40 minute washing period, the wash liquor was circulated and the pumping was interrupted every two minutes for a few seconds to loosen the filter content by the resulting back pressure and thus to prevent clogging of the filter.

The following washing agent components and additives in grams per liter of wash liquor were employed:

| Grams/liter | |
|---|---|
| 0.5 | Na n-dodecylbenzene sulfonate |
| 0.17 | Ethoxylated tallow fatty alcohol (14 mols ethylene oxide) |
| 0.27 | Na soap (tallow fatty acids/behenic |

-continued

| Grams/liter | |
|---|---|
| | acid 1:1) |
| 0.015 | Na ethylenediaminetetraacetate (EDTA) |
| 0.25 | Na silicate ($Na_2:SiO_2$ = 1:3.3) |
| 0.11 | Na carboxymethylcellulose (Na CMC) |
| 2.0 | Sodium perborate tetrahydrate |
| 0.15 | Magnesium silicate |
| 0.2 | Sodium sulfate. |

The following additives were used:

| | Grams/liter | |
|---|---|---|
| (a) | 3.5 | Na tripolyphosphate (TPP) |
| (b) | | No further additions |
| (c) | 0.4 | TPP |
| (d) | 0.4 | TPP |
| | 0.4 | Na citrate |
| (e) | 5.0 | Aluminosilicate (in filter) |
| (f) | 5.0 | Aluminosilicate (in filter) |
| | 0.4 | TPP |
| (g) | 5.0 | Aluminosilicate (in filter) |
| | 0.4 | TPP |
| | 0.4 | Na citrate |

After discharging the wash liquor, the laundry was rinsed with tap water four times and lastly spun dry. The percentage remission values of the textile samples, determined photometrically, were compiled in the following Table I. The abbreviation "P" stands for phosphate.

TABLE I

| Additive Formulation | Characterization | % Remission C | F.C. | P/C |
|---|---|---|---|---|
| a | Comparison, high P | 79 | 70 | 67 |
| b | Comparison, P-free | 57 | 57 | 52 |
| c | Comparison, low P | 55 | 57 | 52 |
| d | Comparison, low P | 57 | 58 | 54 |
| e | Example 1, P-free | 79 | 71 | 64 |
| f | Example 2, low P | 80 | 73 | 67 |
| g | Example 3, low P | 80 | 73 | 71 |

EXAMPLES 4 TO 6

Examples 1 to 3 were repeated with the use of a fluid bed (whirlpool) filter per FIG. V, the aluminosilicate being again introduced in this filter before the start of the washing test. After presoftening as in Examples 1 to 3, the residual hardness of the water was less than 3° dH. The wash liquor was circulated continuously during the entire washing operation. The throughput was 12 liters per minute, the washing time 40 minutes. The other test conditions were maintained as in Examples 1 to 3. The results are given in Table II.

TABLE II

| Example | Additive Formulation | Builders | % Remission C | F.C. | P/C |
|---|---|---|---|---|---|
| — | a | Without aluminosilicate, high P | 79 | 70 | 67 |
| — | b | Without aluminosilicate, no P | 57 | 58 | 54 |
| — | c | Without aluminosilicate, low P | 55 | 58 | 54 |
| — | d | Without aluminosilicate, low P | 57 | 58 | 56 |
| 4 | b | With aluminosilicate, no P | 80 | 73 | 73 |
| 5 | c | With aluminosilicate, low P | 82 | 74 | 73 |
| 6 | d | With aluminosilicate, low P | 82 | 74 | 73 |

EXAMPLES 7 to 9

In the washing agent formulations of Examples 1 to 6, the Na n-dodecylbenzene sulfonate was replaced by the same amount of ethoxylated oxo-alcohol (a $C_{14}$-$C_{17}$ oxo-alcohol with 12 mols ethylene oxide) and the ethoxylated tallow fatty alcohol with 14 mols of ethylene oxide was replaced by one with 5 mols of ethylene oxide. These washing agent formulations containing exclusively nonionic surface-active compounds (designated *b'*, *c'* and *d'*) are especially suitable for low phosphate washing agents and for easy care textiles of finished cotton as well as blended fabrics. The other test conditions were the same as in Examples 4 to 6. The results of the washing tests are listed in Table III.

TABLE III

| Example | Additive Formulation | Builders | % Remission C | F.C. | P/C |
|---|---|---|---|---|---|
| — | b' | Without aluminosilicate, no P | 79 | 68 | 60 |
| — | c' | Without aluminosilicate, low P | 80 | 71 | 74 |
| — | d' | Without aluminosilicate, low P | 80 | 72 | 75 |
| 7 | b' | With aluminosilicate, no P | 82 | 78 | 78 |
| 8 | c' | With aluminosilicate, low P | 83 | 79 | 78 |
| 9 | d' | With aluminosilicate, low P | 83 | 78 | 79 |

EXAMPLES 11 AND 12

With the use of a tub washing machine with a whirlpool bed filter according to FIGS. V and VII, the procedures of Examples 4 and 7 were repeated using the phosphate-free washing agent additive formulations *b* and *b'* and the aluminosilicate Al. Before the washing was started, the fresh water was softened to a hardness of 4.5° dH by circulating for ten minutes. During the washing process (40 minutes at 90° C.) the solution was pumped over the filter for two minutes at a time and then circulation was interrupted for 15 seconds. The average delivery was 8 liters per minute. The other test conditions were maintained unchanged. After draining of the solution, the goods were rinsed with tap water three times. The results are found in Table IV.

TABLE IV

| Formula (P-free) | | % Remission C | F.C. | P/C |
|---|---|---|---|---|
| b | Anionic, without aluminosilicate | 57 | 58 | 54 |
| b | Anionic, with aluminosilicate | 81 | 76 | 75 |
| b' | Non-ionic, without aluminosilicate | 79 | 72 | 73 |
| b' | Non-ionic, with aluminosilicate | 83 | 82 | 79 |

A comparison of the results of the above examples with the corresponding examples of Ser. No. 618,461 shows in all cases a further improvement of the results of the wash tests.

The preceding specific embodiments are illustrative of the practice of the invention. It is to be understood, however, that other expedients known to those skilled in the art or disclosed herein, may be employed without departing from the spirit of the invention or the scope of the appended claims.

I claim:

1. A method for machine washing and cleaning of solid materials utilizing washing and cleaning solutions in the presence of water-insoluble cation exchange agents which are capable of binding the hardness components of the water and the soil, comprising withdrawing and recycling the tap water having a hardness of more than 80 mg CaO/liter in contact with said solid soiled materials through a silicate cation exchange compound having some combined water and a particle size of between 10μ and 100μ of the formula $$(M_{2/n}O)_x \cdot Me_2O_3 \cdot (SiO_2)_y$$

wherein M is a cation of valence $n$ exchangeable with calcium, Me is a member selected from aluminum and boron, $x$ is a number from 0.7 to 1.5 and $y$ is a number from 0.8 to 6, said agent having a calcium binding power of at least 50 mg of CaO per gram, said silicate cation exchange compound being maintained out of contact with said solid soiled materials in a separate area from the washing area, for such time until the water has a hardness of not more than 70 mg CaO/liter, then adding other soluble washing and cleaning compounds to said softened tap water and washing said solid materials while continuing the recycling of the wash solution through said silicate cation exchange compound, wherein the total amount of washing solution is continuously or intermittently cyclically circulated from the washing area through the separate area with the cation exchange compound and then back to the washing area at least five times during the cleaning process, and where the amount of the cation exchange compound is 0.2 gm to 10 gm per liter of washing solution, and said washing solution contains from 0.2 to 10 gm per liter of other soluble washing and cleaning compounds.

2. The process of claim 1 wherein said tap water is recycled until the water has a hardness of less than 50 mg CaO/liter.

3. The process of claim 1 wherein said tap water is recycled until the water has a hardness of less than 30 mg CaO/liter.

4. The process of claim 1 wherein said solid soiled materials are textiles.

5. The process of claim 1 wherein said silicate cation exchange compound is maintained out of contact with said solid soiled materials in a separate area from the washing area by a filter means.

6. The process of claim 5 wherein said filter means is a static bed filter means.

7. The process of claim 5 wherein said filter means is a fluidized bed filter means.

8. The process of claim 1 wherein said silicate cation exchange compound has a calcium binding power of from 100 to 200 mg CaO/gm.

9. The process of claim 1 wherein said silicate cation exchange compound has the formula:

$$(Na_2O)_{0.7-1.5} \cdot Al_2O_3 \cdot (SiO_2)_{1.3-3.3.}$$

10. The process of claim 1 wherein said silicate cation exchange compound is crystalline.

11. The process of claim 1 wherein said other soluble washing and cleaning compounds include an anionic surface-active compound.

12. The process of claim 1 wherein said other soluble washing anc cleaning compounds include a water-soluble sequestering agent for calcium ions.

* * * * *